US005433435A

United States Patent [19]

Bourie

[11] Patent Number: 5,433,435

[45] Date of Patent: Jul. 18, 1995

[54] BATTER TIMING PRACTICE APPARATUS

[76] Inventor: George E. Bourie, 24 Lesley Ave., Auburn, Mass. 01501

[21] Appl. No.: 170,757

[22] Filed: Dec. 21, 1993

[51] Int. Cl.[6] ..... A63B 69/40

[52] U.S. Cl. ..... 273/26 E

[58] Field of Search ..... 273/26 E, 58 C, 411, 273/26 A

[56] References Cited

U.S. PATENT DOCUMENTS

| | | | |
|---|---|---|---|
| 3,531,115 | 9/1970 | Alexander | 273/58 C |
| 3,731,925 | 5/1973 | Caldwell | 273/26 E |
| 4,088,319 | 5/1978 | Clarke | 273/58 C |
| 4,265,448 | 5/1981 | Anderson, Jr. | 273/26 A |
| 4,415,155 | 11/1983 | Goudreau | 273/26 E |
| 4,577,864 | 5/1986 | Aldrich | 273/58 C |
| 4,948,149 | 8/1990 | Lin | 273/411 |
| 5,211,612 | 5/1993 | Carbonero | 273/58 C |

*Primary Examiner*—Theatrice Brown

[57] ABSTRACT

A batter timing practice apparatus including a telescoping handle having a tethered ball attached. In use, the ball is set in motion by an operator and directed toward a practicing batter, the object being to simulate a variety of pitches for actual hitting practice under limited resource conditions. The telescoping handle provides a safe standoff for an operator and collapses to a lightweight, portable unit transportable along with bats and related baseball equipments. An alternate embodiment includes a ground penetrating spike providing for use of the batter timing apparatus by one person.

2 Claims, 3 Drawing Sheets

BATTER TIMING PRACTICE APPARATUS

BACKGROUND OF THE INVENTION

1. Field of the Invention

The present invention relates to baseball training devices and more particularly pertains to a batter timing practice apparatus which may be utilized for the purpose of improving the temporal relationship of the swing of a batter in the sport of baseball and the ballistics of an incoming baseball in order to improve the likelihood of hitting the ball over wide ranges of ball velocity and trajectory parameters.

2. Description of the Prior Art

The use of training devices directed toward improvement of skills in baseball is known in the prior art. More specifically, baseball practice and training devices heretofore devised and utilized for the purpose of improving the performance of players in the sport of baseball are known to consist basically of familiar, expected and obvious structural configurations, notwithstanding the myriad of designs encompassed by the crowded prior art which have been developed for the fulfillment of countless objectives and requirements.

For example, U.S. Pat. No. 5,184,816 to Lunsford discloses a hitting practice device comprising a motorized mechanism causing a tethered ball to move in a circular path at a substantially constant angular velocity whereinto a batter swings a bat or similar device in an attempt to hit the ball. The Lunsord invention is a complicated apparatus when compared to the present invention and furthermore is not generally affordable or transportable by a majority of players of the baseball sport. The present invention requires no external power, is transportable in whole by even a small child, and will cost a small fraction of the Lunsford equipment. In addition, and perhaps most importantly, the present invention provides for a wide range of variability in the velocity and trajectory of the ball thereby better equipping the practicing batter for situations evolving in an actual baseball game.

In U.S. Pat. No. 3,907,287 to Fox et al. a tethered ball batting practice device is disclosed. The Fox et al. invention comprises a lightweight, perforated shellike ball operably coupled to a short handle by a series interconnected cord and spring means. When operably disposed the ball is caused to assume a substantially horizontal trajectory by motion applied by a human operator to the handle. The present invention comprises an elongate, telescoping handle coupled to a tethered ball wherein the ball more or less simulates an actual ball in size, weight, and aerodynamic qualities. The extended handle enables the operator to produce a wide range of ball trajectories not limited to substantially horizontal circles as in the Fox et al. invention. And the ball employed in the present invention, being a simulation of an actual game ball, will provide the batter with a more realistic practice session in producing more realistic velocity and impact effects.

In U.S. Pat. No. 5,165,682 to McGuckin et al. a reflex skill practice device and method is described wherein an elastically tethered ball is affixed to a short handle for the purpose of simulating the character of a baseball striking the ground after being hit or thrown the objective being to provide a method for practice reflex skills in catching a ball after it bounces. The present invention provides a means for improving skills associated with batting a ball and is not employed for practicing catching.

In U.S. Pat. No. to 5,000,450 to Beintema a tethered ball batting practice device is disclosed for purpose of improving those batting techniques not generally associated with the problem of subconscious timing bat swing to impact the ball at a desired spatial location. A disadvantage in this prior art lies in a lack of ball movement required to simulate the batting environment. The present invention employs a moving ball wherein the ball's ballistics may be continuously altered to simulate balls pitched at various rates and trajectories including slow balls, fast balls, curved balls, drop balls, and many additional commonly employed descriptions of the various tools employed by baseball pitchers.

In U.S. Pat. No. 5,048,828 to Love a batting practice device is described wherein a ball hanging at an end of a vertical tether, and additionally being limited in horizontal movement by a second horizontal tether, is hit by a batter in performance of batting practice. The vertical tether is affixed to an arm perpendicularly attached to an upright pole member wherein said pole member is anchored to the playing surface by some means. The second horizontal tether is slidably affixed to the upright pole member. The Love invention simulates pitched balls but, since the energy source for pitched ball simulation lies primarily in the potential energy gained by the ball when the ball and second tether are wrapped around the upright pole member after the ball is hit, there is little or no variability in pitching style afforded the practicing batter and the batter will not be exposed to the various pitching styles encountered in typical baseball game situations. In addition the Love patent is not truly portable even if the upright pole member is anchored by a weighted base and the Love device could not be easily taken from game to game for batter warmup, etc. The present invention can simulate a wide variety of pitching styles and alter these styles on a pitch to pitch basis, and furthermore the present invention is portable and collapses into a form much like a fishing pole thereby being transportable by even a small child.

As illustrated by the background art, efforts are continuously being made to attempt to improve baseball player training apparatus. No prior effort, however, provides the benefits attendant with the present invention. Additionally, the prior patents and commercial techniques do not suggest the present inventive combination of component elements arranged and configured as disclosed and claimed herein.

Therefore, it can be appreciated that there exists a continuing need for a batter timing practice apparatus which can be employed to provide bat swing coordination to enable a batter to hit a wide variety of pitch styles, and furthermore to control timing of the bat-ball impact so that the hit occurs sooner or later in the swing thereby enabling the batter to redirect the ball in a desired direction. In this regard, the present invention substantially fulfills this need.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types now present in the prior art, the present invention provides an improved batter timing practice apparatus construction wherein the same can be utilized for training baseball batters. As such, the general purpose of the present invention, which will be described subsequently in greater detail, is to provide a new and improved batter timing practice apparatus and method which has all of the advantages of the prior art baseball batting training methods and none of the disadvantages.

The invention is defined by the appended claims with the specific embodiment shown in the attached drawings. For the purpose of summarizing the invention, the invention may be incorporated into an elongated handle telescoping to an extended length, a ball, and a cord or line affixed at one end to an end of the elongated handle and affixed to the ball at the end opposite.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention may be better understood so that the present contribution to the art can be more fully appreciated. Additional features of the invention will be described hereinafter which form the subject of the claims of the invention. It should be appreciated by those skilled in the art that the conception and the disclosed specific methods and structures may readily be utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved batter timing practice apparatus.

It is another object of the present invention to provide a new and improved batter timing practice apparatus which may be easily and efficiently manufactured and marketed.

It is a further object of the present invention to provide a new and improved batter timing practice apparatus which is of a durable and reliable construction.

An even further object of the present invention is to provide a new and improved batter timing practice apparatus which is susceptible of a low cost of manufacture with regard to both materials and labor, and which accordingly is then susceptible of low prices of sale to the consuming public, thereby making such batter timing practice apparatus economically available to the buying public.

Still yet another object of the present invention is to provide a new and improved batter timing practice apparatus which provides in the apparatuses and methods of the prior art some of the advantages thereof, while simultaneously overcoming some of the disadvantages normally associated therewith.

Still another object of the present invention is to provide a new and improved batter timing practice apparatus which serves a purpose of improving the ability of a batter to hit a baseball.

Yet another object of the present invention is to provide a new and improved batter timing practice apparatus which incorporates a manually powered pitch simulation which facilitates more variance in simulating pitched ball ballistics thereby providing the baseball batter with enhanced ability to practice in hitting more diversely thrown balls.

Even still another object of the present invention is to provide a new and improved batter timing practice apparatus thereby having a beneficial impact on the baseball sports industry in general.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding may be had by referring to the summary of the invention and the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
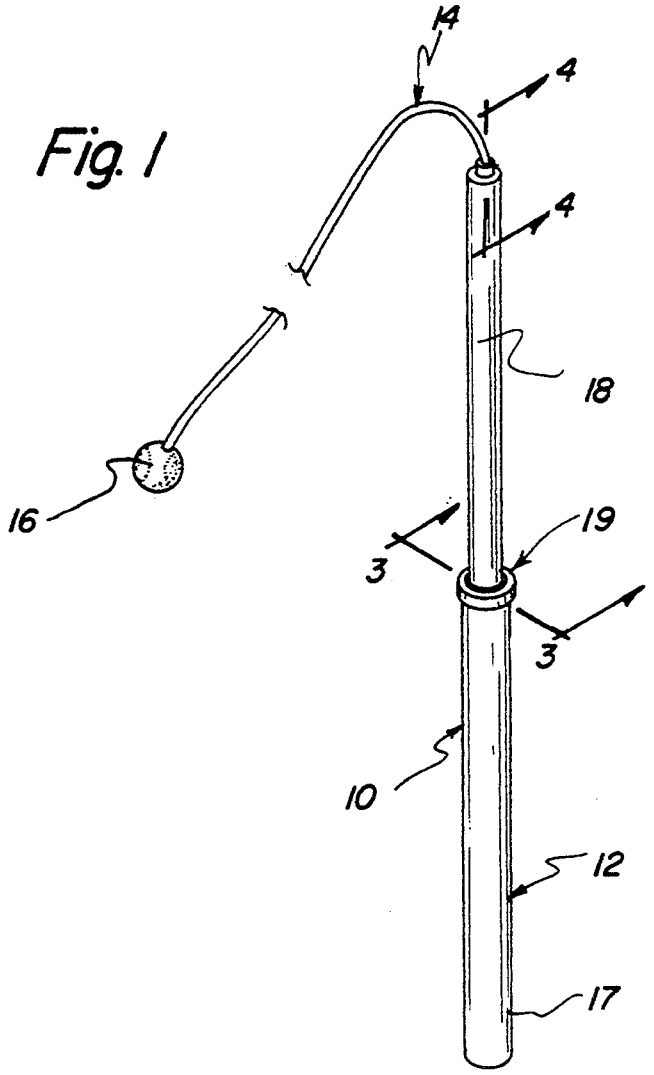
FIG. 1 is a perspective view of the batter timing practice apparatus in a vertical position.

With reference now to the drawings, and in particular to FIG. 1 thereof, a new and improved batter timing practice apparatus embodying the principles and concepts of the present invention and generally designated by the reference numeral 10 will be described.

Figure 2:
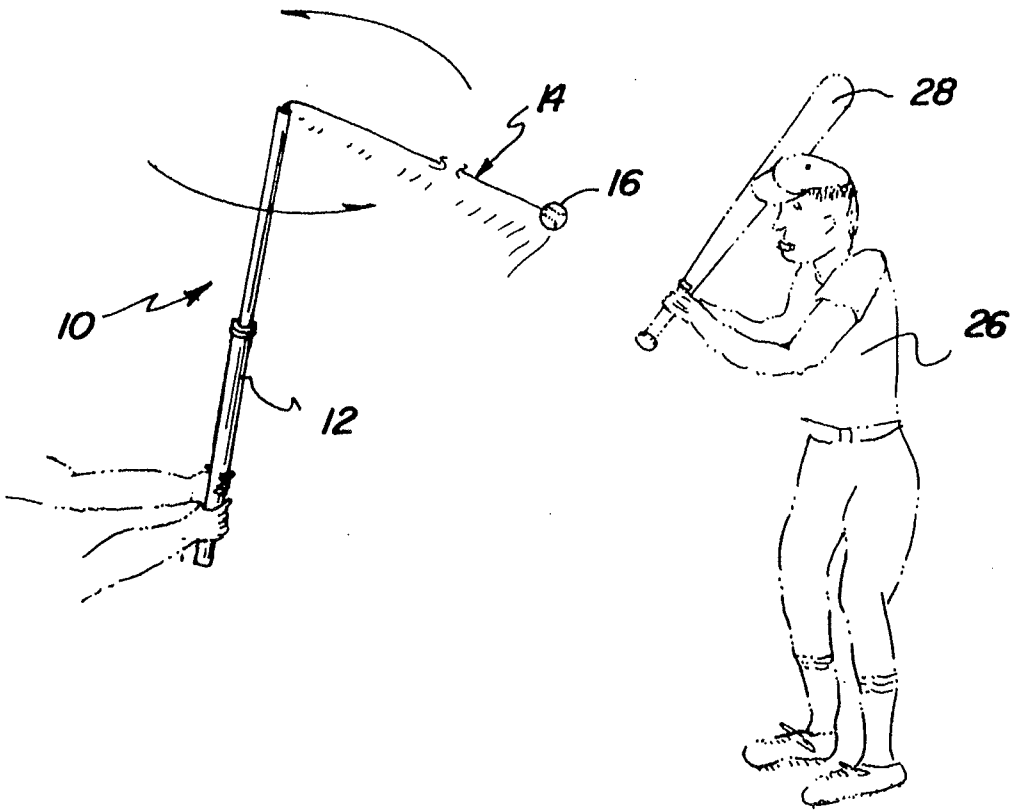
FIG. 2 is a perspective view of the batter timing practice apparatus showing an operational disposition.

From an overview standpoint, the batter timing practice apparatus 10 is adapted for use by a human to improve the timing necessary to endure hitting an incoming baseball. The batter timing practice apparatus 10 comprises a telescoping handle 12 affixing a tether cord 14 which has an attached ball 16 at an end opposite. See FIGS. 1 and 2. Ball 16 therefore is free to move in a circular, or pertubated circular path by applying motive force to handle 12. Batter timing practice apparatus 10 is thereby caused to simulate a wide range of baseball pitch styles for batter 26 to swing bat 28 in an attempt to achieve higher levels of batting proficiency particularly regarding timing the swing of bat 28 to hit ball 16 frequently and in a desirable manner.

More specifically, it will be noted that the batter timing practice apparatus comprises a handle 12 wherein said handle comprises a large diameter portion 17, a small diameter portion 18, and an intermediate portion 19. Large diameter portion 17 is a tubular structure and may be fabricated from materials such as common polyvinylcloride pipe (PVC) or other pipe materials and may be wrapped with tape or fitted with a handgrip for comfort and frictional graspability.

Figure 3:
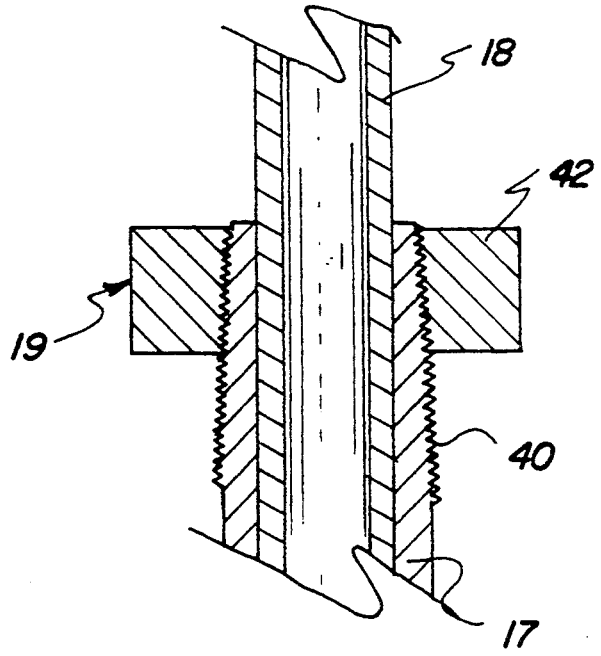
FIG. 3 is a fragmentary side sectional view of the batter timing practice apparatus showing a compression style telescoping handle lock.

Small diameter portion 18 is also a tubular structure, fabricated from materials such as PVC pipe, having an outside diameter slightly less than the inside diameter of larger portion 17, and most importantly capable of frictional locking with larger diameter portion 17 by slight reduction of the inner diameter of larger portion 17. Frictional locking is accomplished by intermediate portion 19 which comprises a compression collet interface. See FIG. 3.

Intermediate portion 19 comprises a threaded end of larger portion 17 wherein said threaded end comprises a taper thread 42 having a smaller pitch diameter at the free end of larger portion 17 and a larger pitch diameter toward the center of larger portion 17. The free end of larger portion 17 may be slotted to facilitate frictional engagement of the inner bore of larger portion 17 and the outer bore of smaller portion 18. Said frictional engagement is provided by collet nut 42 which, when threadedly engaged, causes shrinkage of the inner bore of larger portion 17 thereby frictionally engaging the outer surface of smaller portion 18.

Figure 4:
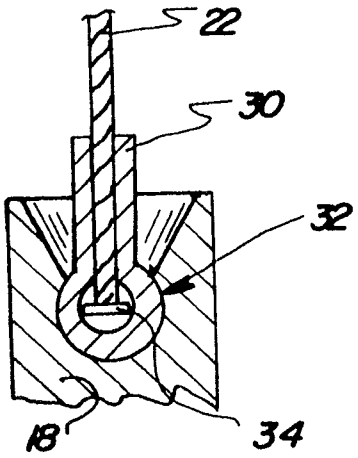
FIG. 4 is a fragmentary sectional view of the batter timing practice apparatus taken substantially upon the plane indicated by the section line 4—4 of FIG. 1 and showing an attachment of the tether to the telescoping handle.

Collet nut 42 may be knurled for ease in applying necessary locking force or may have a wide variety of external features such as flats or spanner wrench holes, the sum total of which are representative of efforts to better apply forces to enhance frictional engagement of smaller portion 18 and larger portion 17. Tether cord 22 is affixed to an extended end of the smaller portion 18 of handle 12 using a ball and socket fastener 32 wherein ball portion 30 affixes tether 22 using an enlarged portion 34 wherein said enlarged portion 34 comprises a knot or plug affixed to tether cord 22 end thereby precluding slippage of cord 22 from ball portion 30. See FIG. 4.

Figure 5:
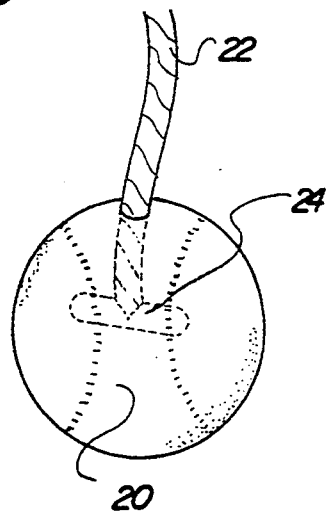
FIG. 5 is a fragmentary perspective view of the batter timing practice apparatus showing a ball attachment means.

The ball and socket attachment means 32 reduces damaging stress at the joining of tether cord 22 and smaller portion 18 by limiting sharp bends in the tether cord 22. An opposite end of tether cord 22 is affixed to ball 20 using an internal anchor 24 as shown in FIG. 5. Anchor 24 may be a hard T shaped device, or an internal knot, or generally any means whereby the physical size of tether cord 22 is enlarged at a free end within the ball 20 thereby maintaining the cord within the ball through extremes of shock and tensile forces as are experienced in use of the batter timing practice apparatus 10. The ball 20 may be bored with a through hole and knots or locking devices may be applied to the tether cord 22 on either side of ball 20 to prevent slippage.

Figure 6:
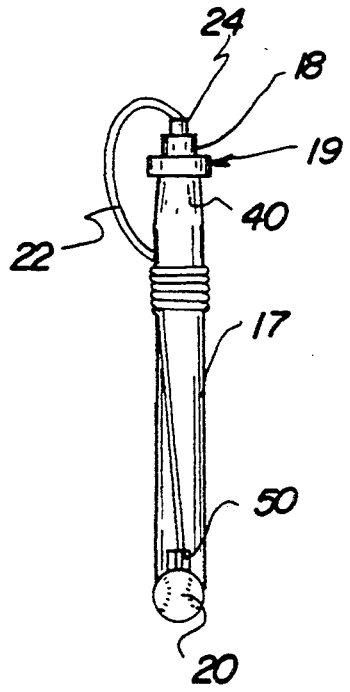
FIG. 6 is a front elevational view of an alternate embodiment of the batter timing practice apparatus in a storage and transporting disposition.

In an alternate embodiment a clip 50 is affixed to the larger portion 17 wherein the clip 50 holds the tethered ball 20 when the telescoping handle 12 is collapsed for the purpose of storage. See FIG. 6.

In another alternate embodiment the non-threaded end of the larger portion 17 is formed into a spike or other ground penetrating form thereby permitting the extended handle 12 to be implanted in soil to introduce yet another desirable baseball practice tool.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved batter timing practice apparatus for improving the ability of a batter to hit a pitched ball comprising:

an elongated handle means having a first portion and a second portion, the first portion being formed in an elongated tubular configuration with a taper threaded end and an outboard end, a collet member threadedly engaging the taper threaded end of the tubular first portion, the outboard end of the first portion adapted to be positioned in the ground in the operative orientation;

an elongated tubular second portion having an external diameter slightly less than the internal diameter of the tubular first portion, the second portion having a first end and a second end, the second end including a socket affixed thereto, the first end of the second portion being slidably engaged through the collet member and received by the taper threaded end of the first portion, the second portion adapted to be frictionally locked within the first portion by application of rotary forces upon the collet member; and a tether cord having an inboard end and an outboard end, a ball being affixed to the outboard end of the tether cord, the inboard end of the tether cord being affixed to the socket on the second end of the second portion of the handle means, the ball adapted to be orbited in varying circular paths through the, strike zone of a batter, the orbiting ball permitting batters to practice the timing of their batting swing.

2. The new and improved batter timing practice apparatus of claim 1 in which the taper threaded end of the first tubular portion of the handle means is slotted with a multiplicity of radial slots wherein the slots perforate the wall of the elongated tubular first portion for a substantial part of the threaded length.

* * * * *